US005236311A

United States Patent [19]

Lindstrom

[11] Patent Number: 5,236,311

[45] Date of Patent: Aug. 17, 1993

[54] COMPRESSOR DEVICE FOR CONTROLLING OIL LEVEL IN TWO-STAGE HIGH DOME COMPRESSOR

[75] Inventor: Robert A. Lindstrom, Tecumseh, Mich.

[73] Assignee: Tecumseh Products Company, Tecumseh, Mich.

[21] Appl. No.: 819,090

[22] Filed: Jan. 9, 1992

[51] Int. Cl.[5] ..... F04B 41/06; F25B 1/10

[52] U.S. Cl. ..... 417/254; 62/510

[58] Field of Search ..... 417/254, 228, 255; 62/510, 468, 470, 84

[56] References Cited

U.S. PATENT DOCUMENTS

| | | | |
|---|---|---|---|
| 3,140,041 | 7/1974 | Kramer et al. | 230/44 |
| 3,360,958 | 1/1968 | Miner | 62/470 |
| 3,500,962 | 3/1970 | Kocher | 62/468 |
| 3,581,519 | 6/1971 | Garrett, Jr. | 62/468 |
| 3,621,670 | 1/1970 | Kinney | 62/192 |
| 3,785,169 | 1/1974 | Gylland, Jr. | 62/468 |
| 4,102,149 | 7/1978 | Conley et al. | 62/196 |
| 4,383,802 | 5/1983 | Gianni et al. | 417/12 |
| 4,411,141 | 10/1983 | Hara | 62/468 |
| 4,530,215 | 7/1985 | Kramer | 62/84 |
| 4,589,263 | 5/1986 | DiCarlo et al. | 62/193 |
| 4,672,822 | 6/1987 | Iijima et al. | 62/468 |
| 4,748,820 | 6/1988 | Shaw | 62/175 |
| 4,750,337 | 6/1988 | Glamm | 62/468 |
| 4,870,831 | 10/1989 | Kitamoto | 62/84 |
| 4,895,498 | 1/1990 | Basseggio | 417/426 |
| 5,113,671 | 5/1992 | Westermeyer | 62/84 |

*Primary Examiner*—Richard A. Bertsch
*Assistant Examiner*—Peter Korytnyk
*Attorney, Agent, or Firm*—Baker & Daniels

[57] ABSTRACT

A multi-stage compressor assembly including an arrangement for controlling the oil level having first and second capillary tubes. First capillary tube connects between the second stage high pressure housing at a level above the normal oil sump level to the first stage low pressure housing. The second capillary tube connects from the first stage housing at a point above the normal sump level to a point on the second stage suction tube. The oil level is automatically self compensating by the location of the capillary tube inlets and by differential housing pressure urging oil migration through the capillary tubes.

23 Claims, 1 Drawing Sheet

COMPRESSOR DEVICE FOR CONTROLLING OIL LEVEL IN TWO-STAGE HIGH DOME COMPRESSOR

BACKGROUND OF THE INVENTION

The present invention relates generally to refrigeration systems and more particularly to means for controlling the oil levels in two-stage serially connected compressors.

A well-known class or type of compressor such as are used for example in refrigeration and air-conditioning system is a hermetically sealed compressor which is characterized by the fact that the compressor and its electric drive motor are enclosed within a single housing and the drive shaft of the motor is connected to the crankshaft of the compressor.

There are many refrigeration applications requiring cooling to a very low temperature. Some applications may call for the installation of two or more compressors in series or parallel. As the refrigerant passes through a multi-stage compressor system, a certain amount of compressor lubricating oil becomes intermixed with refrigerant. This oil migration through the system sometimes prevents full lubrication of the compressors at all times. Oil leakage out of the compressors may become severe enough for the compressors to be starved of lubricating oil and fail.

A primary difficulty in serially connected compressors is of maintaining an adequate oil level in the crankcases of the different compressors which may receive recirculating or migrating oil, and lose oil again at varying rates. The rate at which lubricating oil is discharged out of a compressor along with compressed refrigerant is called the oil loss rate or simply the loss rate.

In the prior art, oil level controls operated by means of conduits, between the various compressors, connected with pumps, valves, oil holding tanks or other means for equalizing the oil level between the compressors.

A prior art patent issued to Miner, U.S. Pat. No. 3,360,958, discloses a lubrication apparatus disposed within a multiple compressor system having an oil accumulator within the refrigerant line that traps circulating oil. A float valve permits captured oil to travel into the compressor oil sumps. The oil sumps are connected together with conduits located at the desired oil levels within each compressor. Excess oil collects into a receiver where refrigerant flow pulls oil back into the refrigerant stream through an ejector.

Problems with prior art designs include a varying flow of oil within the lubricant systems, dependant upon refrigerant flow and extra lubrication system parts that may wear out and leak.

The present invention is directed to overcoming the aforementioned problem associated with compressors connected in series where it is desired to provide adequate oil levels within the compressor housings with a substantial decrease in the number of parts.

SUMMARY OF THE INVENTION

The present invention overcomes the disadvantages of the above-described prior art refrigeration systems by providing an improved oil level control device capable of equalizing oil levels between serially connected hermetic compressors.

Generally, the invention provides a two-stage compressor assembly comprising a first stage low pressure compressor and a second stage high pressure compressor connected in series. A first capillary tube connects between the high pressure housing and the low pressure housing with the capillary tube having an inlet in the high pressure housing above the normal oil sump level and an outlet in the lower pressure housing. When the oil level in the high pressure sump is above the first inlet, high pressure will cause migration of oil through the first capillary tube to the low pressure housing. A second capillary oil tube connects from the low pressure housing at a point above the normal sump level to the high pressure compressor suction tube. When the oil level in the low pressure oil sump is above the second capillary tube inlet, compressor pressure will cause migration of oil through the second capillary tube to the second stage compressor suction tube.

In one form of the invention, the first capillary tube inlet is connected to the high pressure housing at a point that would be below the oil level of the high pressure oil sump if the oil sump volume was increased by more than 10%. The first and second capillary tubes have an oil transfer rate equal to the loss rate of either the first compressor or the second compressor plus 20% of the loss rate.

An advantage of the two-stage compressor assembly of the present invention according to one form thereof, is that of oil level control by neither electro-mechanical or optical means. Accordingly, the two compressor assembly does not need additional oil pumps or the like for controlling the oil sump level within each compressor.

Another advantage of the compressor assembly of the present invention is that of creating an inexpensive and simpler oil control mechanism that uses fewer parts than prior designs.

A further advantage of the oil control mechanism of the present invention is the oil sump level is controlled to prevent the oil from contacting the compressor rotor.

The invention in one form thereof, provides a two stage compressor assembly having a first stage low pressure compressor serially connected to a second stage high pressure compressor, with a first and second capillary tubes for controlling the compressor oil levels within each compressor. The first stage low pressure compressor has a sealed hermetic housing containing a motor compressor unit and an oil sump having a normal oil volume with a normal sump level. The first stage compressor has a discharge tube connected to a suction tube of the second stage compressor. The second stage high pressure compressor having a sealed hermetic housing like the first containing a motor compressor unit and an oil sump having a normal oil volume with a normal sump level. The second stage compressor discharge tube is connected to the second stage housing.

In one aspect of the invention, a first capillary oil tube is connected from the high pressure housing to the low pressure housing. This first oil tube has an inlet in the high pressure housing above the normal sump level and an outlet in the low pressure housing, whereby when the oil level in the high pressure sump is above the first inlet, high pressure in the high pressure housing will cause migration of oil thorough this first capillary tube to the low pressure housing. A second capillary oil tube connects from the low pressure housing to the suction side of the high pressure compressor. The second oil tube has an inlet in the low pressure housing above the normal sump level and an outlet in the high pressure compressor suction tube, whereby when the oil level in said sump of the low pressure housing is above the second tube inlet, fluid pressure in the low pressure housing will cause migration of oil thorough the second capillary tube to the high pressure suction tube.

In one form of the invention, the second capillary tube connects from the low pressure housing to the high pressure compressor suction tube. In some forms of the present invention, the high pressure suction tube of the high pressure compressor extends through the high pressure housing.

A significant aspect of the invention is that the capillary tubes have one-way oil flow to transfer excess oil and that the tubes only transfer oil when their respective inlets are submerged in oil. The inlets are located on points of their respective housings to prevent sumping. Sumping is the condition when the oil level within the oil sump is too high within the compressor and the rotor rotates within the oil.

In accord with another aspect of the invention, the first capillary tube is connected to the high pressure housing at a point where the inlet would be below the oil level of the high pressure oil sump if oil in the high pressure oil sump increased in volume by more than about ten percent over the normal oil volume in the sump.

In accord with a further aspect of the invention, the first capillary tube has an oil transfer rate equal to the oil loss rate of the second compressor, plus about twenty percent of the loss rate.

According to a further aspect of the invention, the second capillary tube has an oil transfer rate equal to the oil loss rate of the first compressor, plus about twenty percent of the loss rate.

BRIEF DESCRIPTION OF THE DRAWING

The above mentioned and other features and objects of this invention, and the manner of attaining them, will become more apparent and the invention itself will be better understood by reference to the following description of the preferred embodiment of the invention taken in conjunction with the accompanying drawing, wherein.

Figure 1:
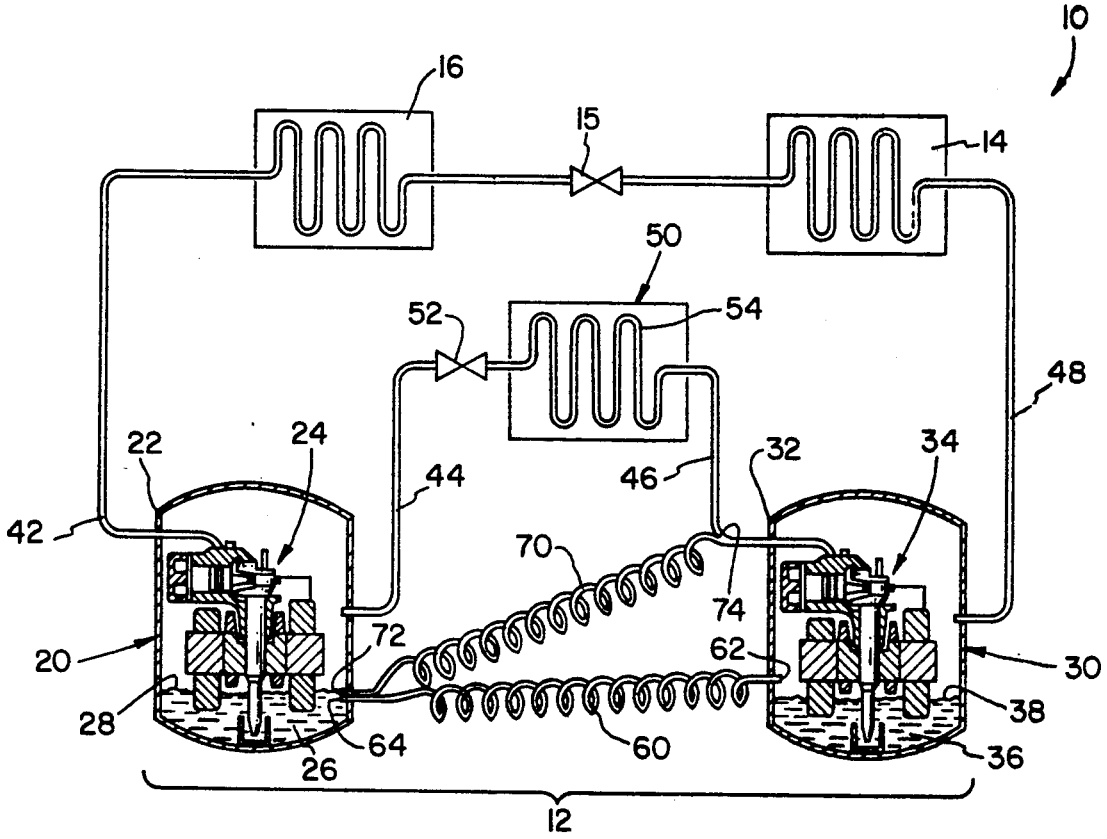
FIG. 1 is a schematic view of a two-stage refrigeration system incorporation the present invention.

The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Referring to FIG. 1, there is shown a refrigeration system 10 having a two-stage compressor assembly 12. Refrigeration system 10 comprises a condenser 14, evaporator 16, and twostage compressor assembly 12 all connected serially in a closed loop arrangement. A metering device 15 may be connected between condenser 14 and evaporator 16.

Two-stage compressor assembly 12 comprises a first stage low pressure compressor 20 and a second stage high pressure compressor 30. Low pressure compressor 20 has a sealed hermetic housing 22 surrounding a motor compressor unit 24. Within housing 22 is an oil sump 26 having a normal oil sump level 28.

High pressure compressor 30 has a sealed hermetic housing 32 surrounding a motor compressor unit 34. Within housing 32 is an oil sump 36 having a normal volume of oil with a normal oil sump level 38.

First stage compressor 20 includes a suction tube 42 connecting through housing 22 to motor compressor unit 24. Discharge tube 44 is attached to hermetic housing 22 which is in communication with high pressure compressor suction tube 46. Suction tube 46 is attached through high pressure housing 32 to motor compressor unit 34. Discharge tube 48 connects from high pressure housing 32 to condenser 14. As shown in FIG. 1, between low pressure discharge tube 44 and high pressure suction tube 46 is a desuperheater 50 comprising a throttling valve 52 and cooling coils 54. Cooling coils 54 cool refrigerant from first stage compressor 20 but maintain refrigerant in a vaporized state.

The device of the present invention for controlling the oil level in two-stage compressor assembly 12 comprises first capillary tube 60 and second capillary tube 70. First capillary tube 60 includes an inlet 62 positioned in housing 32 above normal oil sump level 38. First capillary tube outlet 64 is disposed in housing 22. Second capillary tube 70 includes an inlet 72 disposed in hermetic housing 22 normally above normal oil sump level 28. The outlet 74 of second capillary tube 70 is disposed within high pressure suction tube 46.

In operation, the two-stage compressor 12 begins by compressing refrigerant in first stage low pressure compressor 20. Then refrigerant enters discharge tube 44 and becomes cooled by the action of desuperheater 50. Refrigerant then passes through suction tube 46 into second stage motor compressor unit 34. At this point, the refrigerant becomes highly compressed and exits second stage high pressure housing 32 through discharge tube 48.

The rest of the system comprising condenser 14 in serial connection to evaporator 16 operates in the customary way of known refrigeration systems.

During operation of the two compressor units 24 and 34, entrained oil within the refrigerant lines and oil agitated within oil sumps 26 and 36 move throughout refrigeration system 10. At times, this movement of oil creates locations where the oil supply is too great for efficient operation or when there is not enough oil lubricant to satisfy the needs of motor compressor units 24 and 34. To affect a change in the local concentration of oil within the high pressure housing, capillary tube 60 has an inlet 62 located above the normal oil sump level 38.

In the preferred embodiment, inlet 62 shall be located where it will be submerged in oil if the normal volume of oil within hermetic housing 32 increases by approximately 10% or more. If this happens, high pressure from within hermetic housing 32 will urge oil through capillary tube 60 and into low pressure housing 22. The capillary tube is sized to allow oil transfer from the second stage high pressure housing 32 to first stage 22, preferably at a rate equivalent to the loss rate of oil from the first stage compressor 20 through discharge tube 44 plus 20% of the loss rate. This ensures that the transfer rate of the capillary tube 60 would always be greater than the oil arriving from first stage compressor 20. The rate of transfer and gas leakage rate through capillary tubes 60 and 70 are determined by capillary diameter and length.

Second capillary tube 70 permits transfer of oil from housing 22 to suction tube 46. Inlet 72 of second capillary tube 70 is preferably placed at a point in housing 22 that if the oil level 28 or volume of the oil increased by 10% or more, inlet 72 Would be submerged in oil thereby allowing pressure within hermetic housing 22 to force oil to suction tube 46. In this case too, the transfer rate of capillary tube 70 preferably should be 1.2 times the oil flow rate from refrigerator system 10 through suction tube 42.

Both capillary tubes 60 and 70 permit oil flow in only one direction. This one way oil flow is caused by the pressure differential operating between the inlets and outlets of tubes 60 and 70.

It is evident that the structure and location of the capillary tubes in the aforementioned arrangement allow for a self compensating oil control mechanism in which oil levels within both compressor housings 22 and 32 are normally kept within about 10% of their desired volume. As an additional safe guard, the discharge tubes also limit the total oil build up within either compressor and if the oil level ever reaches the discharge tube 44 or 48 oil will be transferred out of that housing.

There is an alternative to connecting second capillary tube 70 to suction tube 46 of high pressure compressor 30. The second capillary tube outlet 74 may be disposed within the suction side of compressor 34. This permits the invention to function, as in the preferred embodiment, but has a disadvantage of another penetration of housing 32.

This invention is also applicable to multiple serially connected compressors as well. At times, it may be needed to connect three or more compressors together for particular applications. One or more additional compressors may be serially connected with the other compressors including the first and second capillary tubes connected as previously described.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A two stage compressor assembly comprising:

a first stage low pressure compressor having a sealed hermetic housing containing a motor compressor unit inside, said first stage compressor containing an oil sump having a normal oil volume with a normal sump level, said first stage compressor having a discharge tube;

a second stage high pressure compressor having a sealed hermetic housing containing a motor compressor unit inside, said second stage compressor containing an oil sump having a normal oil volume with a normal sump level, said second stage compressor having a suction tube and discharge tube, said first stage compressor discharge tube connected to said second stage compressor suction tube, said second stage compressor discharge tube connected to said second stage housing;

a first capillary oil tube with an absence of intermediate valves and electronic control means, said first tube connecting from said high pressure housing to said low pressure housing, said first tube having an inlet in said high pressure housing above said normal sump level and an outlet in said low pressure housing, whereby when the oil level in said sump of said high pressure housing is above said first inlet, high pressure in said high pressure housing will cause migration of oil thorough said first capillary tube to said low pressure housing; and a second capillary oil tube with an absence of intermediate valves and electronic control means, said second tube connecting from said low pressure housing to the suction side of said high pressure compressor, said second tube having an inlet in said low pressure housing above said normal sump level and an outlet in said high pressure compressor suction tube, whereby when the oil level in said sump of said low pressure housing is above said second tube inlet, fluid pressure in said low pressure housing will cause migration of oil thorough said second capillary tube to said high pressure suction tube.

2. The two stage compressor of claim 1 in which said second capillary tube connects from said low pressure housing to said high pressure compressor suction tube.

3. The two stage compressor of claim 2 in which said high pressure suction tube extends through said high pressure compressor housing.

4. The two stage compressor of claim 1 in which said first capillary tube has one-way oil flow from said high pressure housing to said low pressure housing.

5. The two stage compressor of claim 1 in which said second capillary tube has one-way oil flow from said low pressure housing to said high pressure housing suction tube.

6. The two stage compressor of claim 1 in which said first and second capillary tubes transfer oil between said housings when each said tube inlet is submerged in oil.

7. The two stage compressor of claim 1 in which said first capillary tube is connected to said high pressure housing at a point where said first capillary tube inlet would be below the oil level of said high pressure oil sump if oil in said high pressure oil sump increased in volume by more than about ten percent over said normal oil volume.

8. The two stage compressor of claim 1 in which said first capillary tube has an oil transfer rate equal to the oil loss rate of said second compressor, plus about twenty percent of said loss rate.

9. The two stage compressor of claim 1 in which said second capillary tube has an oil transfer rate equal to the oil loss rate of said first compressor, plus about twenty percent of said loss rate.

10. The two stage compressor of claim 1 in which said first capillary tube has an oil transfer rate equal to the oil loss rate of said second compressor, plus about twenty percent of said loss rate and said second capillary tube has an oil transfer rate equal to the oil loss rate of said first compressor, plus about twenty percent of said loss rate.

11. The two stage compressor of claim 1 in which said first capillary tube inlet is connected to a point on said low pressure housing sufficient to prevent sumping.

12. A refrigeration system having a condenser, an evaporator, and a two stage compressor connected together in a closed loop, said system comprising:

a first stage low pressure compressing means surrounded by a first housing containing a first oil sump having a normal oil volume with a normal sump level, said first housing having a suction tube and a discharge tube, said suction tube connected between said evaporator and said low pressure compressing means;

a second stage high pressure compressing means surrounded by a second housing containing a second oil sump having a normal oil volume with a normal sump level, said second housing having a suction tube and a discharge tube, said second housing suction tube connected between said first housing discharge tube and said second compressing means, said second housing discharge tube connected to said condenser;

a first capillary oil tube with an absence of intermediate valves and electronic control means, said first tube having an inlet in said second housing and an outlet in said first housing, said first tube inlet being above said second normal sump level; and a second capillary oil tube with an absence of intermediate valves and an electronic control means, said second tube having an inlet in said first housing and an outlet in said second housing suction tube said second tube inlet being above said first normal sump level.

13. The system of claim 12 in which said first capillary tube has one-way oil flow from said second housing to said first housing.

14. The system of claim 12 in which said second capillary tube has one-way oil flow from said first housing to said second housing suction tube.

15. The system of claim 12 in which said first capillary tube inlet is connected to said second housing at a point where said first tube inlet would be below the oil level of said second oil sump if oil in said second oil sump increased in volume by more than about ten percent of said normal oil volume.

16. The system of claim 12 in which said first capillary tube has an oil transfer rate equal to the oil loss rate of said second compressor, plus about twenty percent of said loss rate and said second capillary tube has an oil transfer rate equal to the oil loss rate of said first compressor, plus about twenty percent of said loss rate.

17. The system of claim 12 in which said first capillary tube outlet is connected to a point on said first housing sufficient to prevent sumping.

18. An oil level controlling device adapted for use in a two stage compressor having a first compressor means and first oil sump disposed within a first housing connected by a passageway in series to a second compressor means and second oil sump disposed within a second housing, each said oil sump having a normal oil volume with a normal oil level, said device comprising:

a first oil capillary tube with an absence of intermediate valves and electronic control means, said first tube connecting between said second housing and said first housing, said first tube having an inlet in said second housing and an outlet in said first housing, said inlet being above said normal oil level; and a second oil capillary tube with an absence of intermediate valves and electronic control means, said second tube connecting between said first housing and said passageway, said second tube having an inlet in said first housing and an outlet in said passageway, said second tube inlet being above said normal oil level.

19. The device of claim 18 in which said first capillary tube has one-way oil flow from said second housing to said first housing.

20. The device of claim 18 in which said second capillary tube has one-way oil flow from said first housing to said passageway.

21. The device of claim 18 in which said first capillary tube is connected to said second housing at a point where said first capillary tube inlet would be below the oil level of said second oil sump if oil in said second oil sump increased in volume by more than about ten percent of said normal oil volume.

22. The device of claim 18 in which said first and second capillary tubes have a oil transfer rate equal to the oil loss rate of one of said first compressor means and said second compressor means, plus about twenty percent of said loss rate.

23. The device of claim 18 in which said first capillary tube outlet is connected to a point on said first housing sufficient to prevent sumping.

* * * * *